US005474462A

United States Patent [19]

Yamanashi

[11] Patent Number: 5,474,462

[45] Date of Patent: Dec. 12, 1995

[54] CONNECTOR SYSTEM WITH A LEVER REQUIRING SMALL FORCE

[75] Inventor: Makoto Yamanashi, Haibara, Japan

[73] Assignee: Yazaki Corporation, Tokyo, Japan

[21] Appl. No.: 283,892

[22] Filed: Aug. 3, 1994

Related U.S. Application Data

[63] Continuation of Ser. No. 52,767, Apr. 27, 1993, abandoned.

[30] Foreign Application Priority Data

May 1, 1992 [JP] Japan ..... 4-112579

[51] Int. Cl.[6] ..... H01R 13/62

[52] U.S. Cl. ..... 439/157; 439/153

[58] Field of Search ..... 439/152–160, 439/372, 341, 351–358

[56] References Cited

U.S. PATENT DOCUMENTS 4,751,860 6/1988 Rudnev et al. ..... 76/107
5,135,408 8/1992 Suzuki ..... 439/372
5,135,410 8/1992 Kawase et al. ..... 439/372
5,230,635 7/1993 Takenouchi et al. .

FOREIGN PATENT DOCUMENTS 52-133993 10/1977 Japan .

*Primary Examiner*—David L. Pirlot
*Attorney, Agent, or Firm*—Jacobson, Price, Holman & Stern

[57] ABSTRACT

A connector system with a lever requiring a small force for connecting a pair of male and female connectors by pivoting a lever. The connector system includes a male connector having a cam pin, a female connector having a pin guiding portion into which the cam pin enters, and a lever member having a cam groove with which the cam pin is engaged and pivoted to the female connector. After the male and female connectors are connected completely by pivoting the lever member, the lever member is engaged with a resilient locking piece arranged in the female connector.

5 Claims, 14 Drawing Sheets

CONNECTOR SYSTEM WITH A LEVER REQUIRING SMALL FORCE

This application is a continuation of application Ser. No. 08/052,767, field Apr. 27, 1993, now abandoned.

BACKGROUND OF THE INVENTION

1. Field of the Invention

The present invention relates to a connector system in which a pair of male and female connectors can be connected to each other by using an operation lever, and more particularly, to a connector system in which the insertion of one connector can be inserted into another connector requiring only a small force.

2. Description of the Related Art

One example of conventional connector systems of this sort is disclosed in the Japanese Utility Model Unexamined Publication No. 52-133983. In this connector system, an operation lever having cam grooves is attached to both sides of the male connector via supporting pins, and cam pins with which the cam grooves of the operation lever are engaged are provided on both sides of the female connector. Further, locking means for the operation lever are arranged in the male connector. At the initial connection of the connectors, the cam grooves are engaged with the cam pins and the lever is pressed in the inserting direction so as to be pivoted, thereby advancing the male connector into the female connector while requiring a small force due to the action of a lever. Thus, the connection of the connectors is completed at the position where the operation lever is engaged with the locking means.

In the connecting operation of the conventional connector system with a lever requiring only a small force as described above, the cam grooves of the operation lever are adapted to gradually bring the cam pins and the supporting pins closer relative to the operation angles of the operation lever. Accordingly, a force for inserting a pair of terminals in the connector system incessantly affects the operation of the lever. Thus, the completion of the insertion cannot be verified until the completion of the locking operation by the engagement of the operation lever with the locking means is acknowledged visually or the like. Also, a force for inserting the terminals is exerted on the operation of the lever until the locking operation is completed by the locking means at the last stage of the lever, which inhibits the carrying out of the connection of the connectors requiring only a small force.

SUMMARY OF THE INVENTION

In view of the foregoing problems, an object of the present invention is to provide a connector system requiring only a small force by operating a lever in which the load for inserting terminals is substantially eliminated during the locking operation with a lever achieved by classifying the regions of cam grooves which function as supporting points of the operation lever into a connector inserting region and a locking region, thereby increasing the speed of the lever operation and reducing the load during the locking operation at the same time.

Also, in the conventional connector system requiring only a small force with a lever of the sort described above, at the initial stage of the connection of the male and female connectors, the lever is secured at a fixed starting point by urging the spring in the opposite direction of the operating direction for the connection of the connectors in order to secure the engagement of the cam grooves and the cam pins opposite to each other, which results in an increase of the load against the lever due to the spring. In order to overcome such a drawback, another object of the present invention is to provide a connector system requiring only a small force by operating a lever in which the fixed starting point of the lever is secured without using the spring against the lever operation.

To achieve these objects, there is provided a connector system with a lever requiring only a small force comprising a male connector having cam pins; a female connector which has pin guiding portions and into which the cam pins are inserted; and a lever member having cam grooves with which the cam pins are engaged, the lever member being pivoted to the female connector; wherein the lever member is locked after the male and female connectors are connected completely by pivoting the lever member; and wherein a lever member arranged in a frame which accommodates one connector or the other connector is engaged with a positioning projection for the connection of a pair of connectors, and accordingly open ends of the cam grooves of the lever member fit pin guiding grooves of the one connector or the frame correctly, and wherein at the initial connecting state of the one connector and the other connector, the other connector releases the engagement of the lever member and the positioning projection.

In the connector system having the foregoing construction according to the present invention, the load for connecting the connectors and the load for locking are distributed in accordance with the main portions of the pivoting operation of the lever member and the subsequent small operation ranges, and thus, on the whole, the load for connecting the connectors is reduced and the load for operating the lever is lessened without using a spring for positioning the lever member.

Other objects and advantages of the invention will appear more fully from the following description of the invention.

DESCRIPTION OF THE PREFERRED EMBODIMENTS

Figure 1:
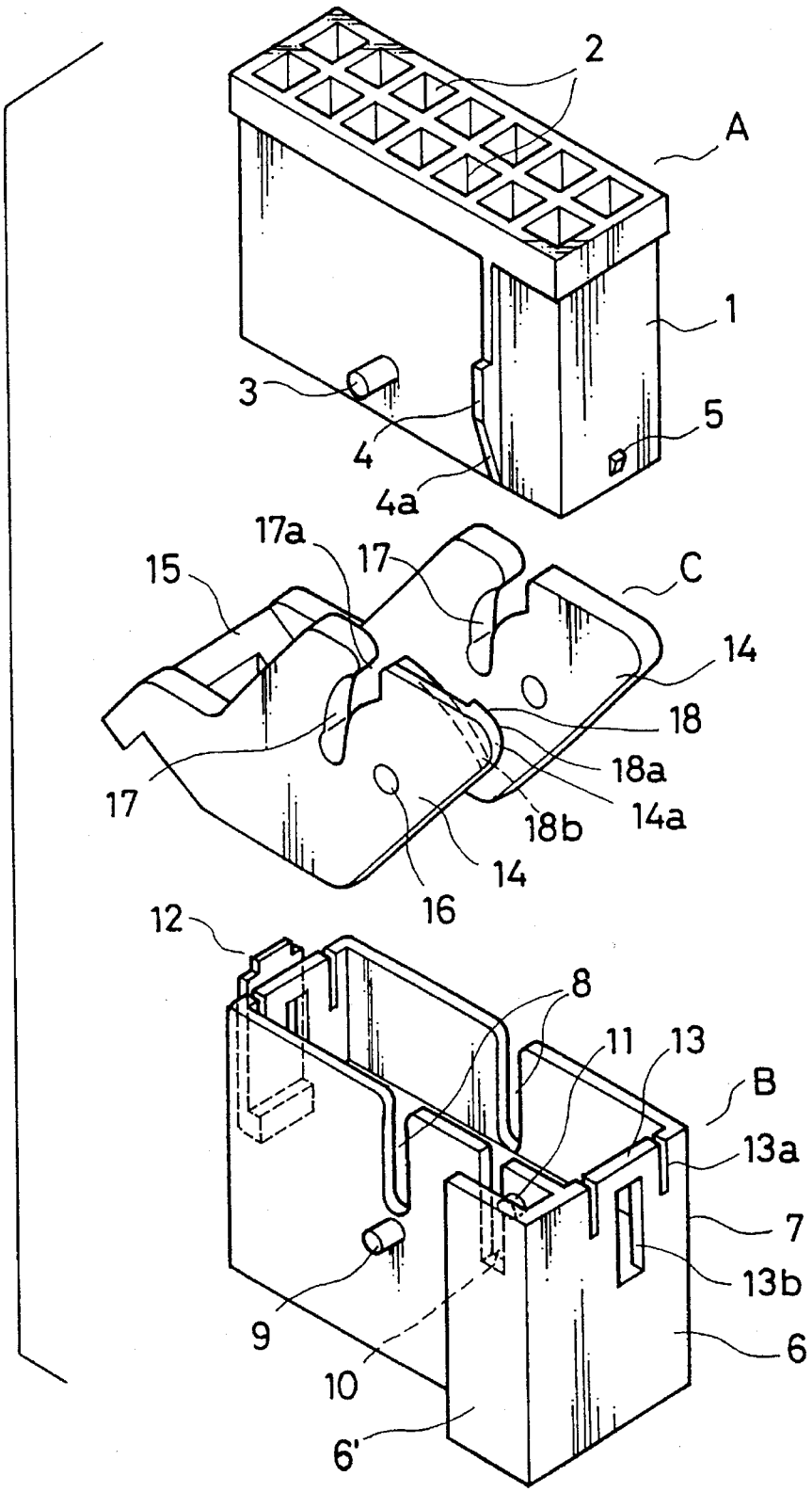
FIG. 1 an exploded perspective view of a connector system with a lever showing one embodiment of the present invention.
Figure 2:
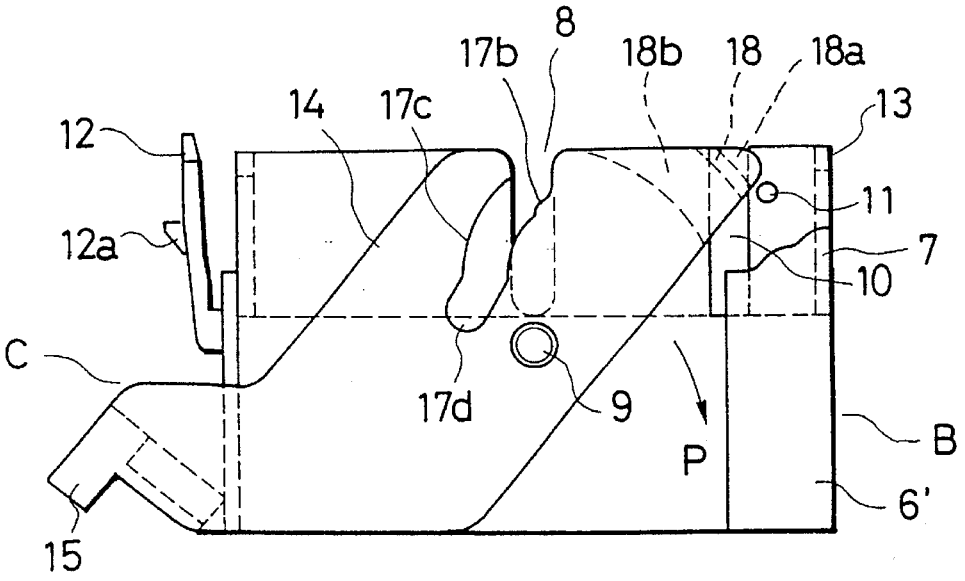
FIG. 2 is side view showing a female connector to which a lever is attached.
Figure 3:
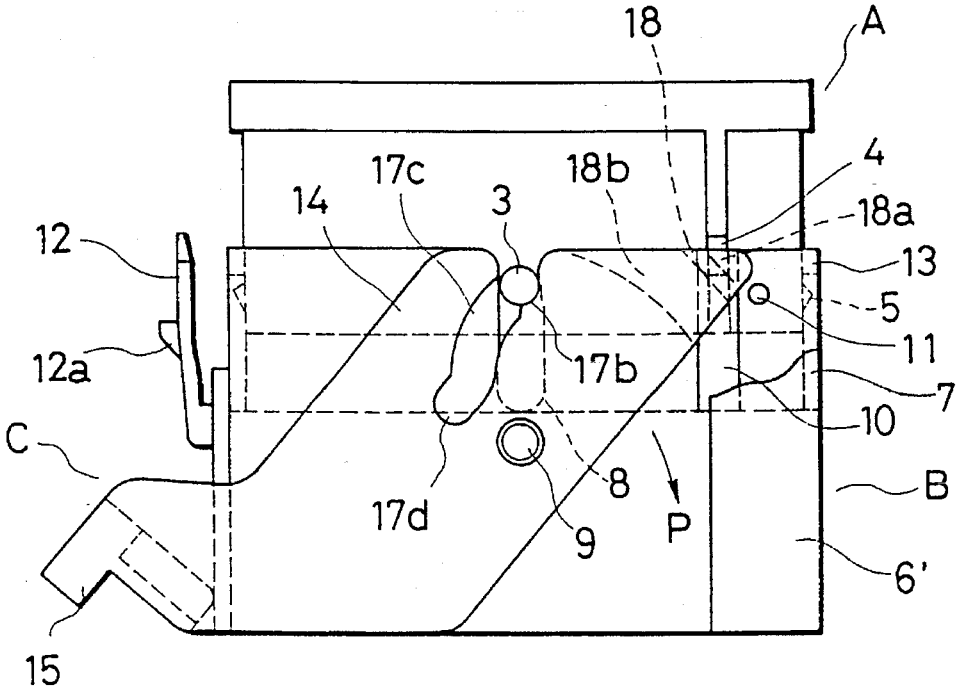
FIG. 3 is a side view of male and female connectors at the start of the connection.
Figure 4:
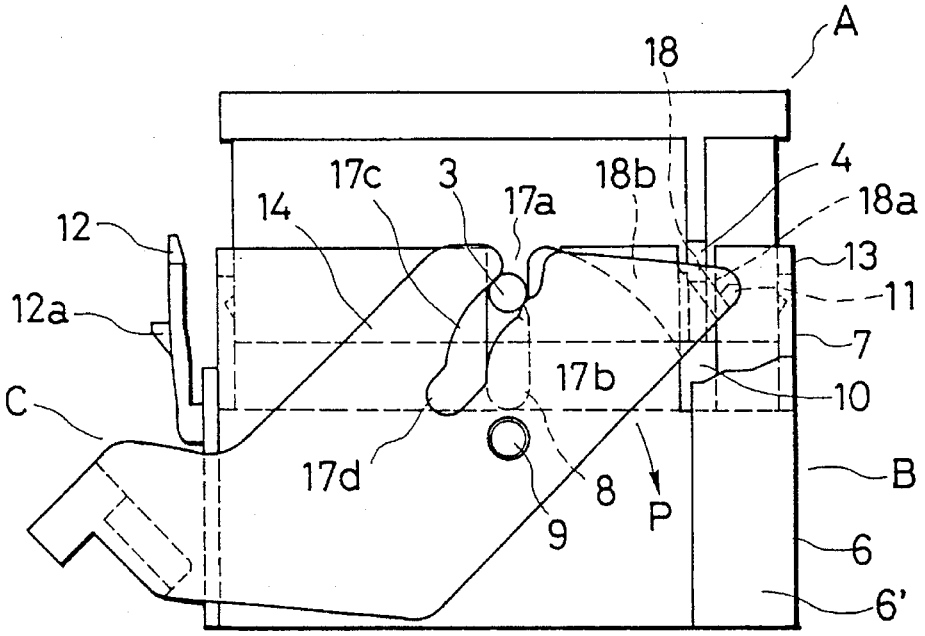
FIG. 4 is a side view of the male and female connectors at the initial stage of the connection.
Figure 5:
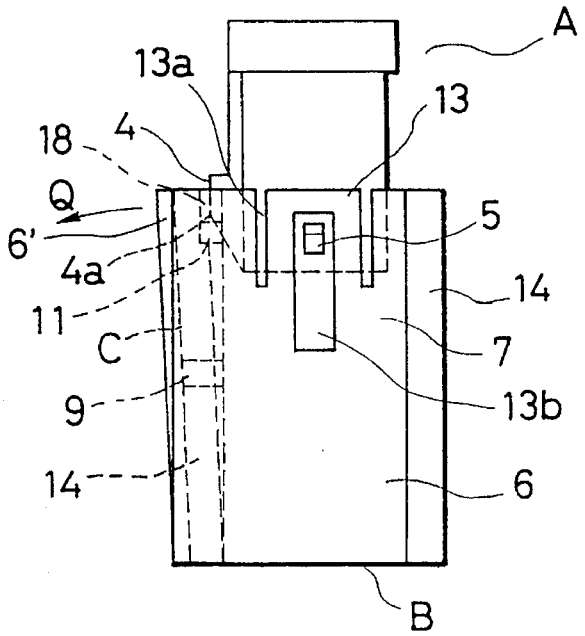
FIG. 5 is a rear view of the male and female connectors at the start of the connection.

Embodiments of the present invention will be described hereinafter with reference to the accompanying drawings. FIGS. 1–7 show a first embodiment of a connector system requiring a small force by using an operation lever according to the present invention. The connector system includes a male connector A, a female connector B and a lever member C. The male connector A includes a housing 1 which has four side walls and is formed of a synthetic resin. Further, cam pins 3 are projected longitudinally from both side walls of the housing 1 and a releasing rib 4 extending from a front end to a rear end of the side wall is projected behind the cam pin 3 from one side wall. A preliminary locking piece 5 is also projected from a rear wall of the housing 1. A plurality of terminal chambers are arranged within the housing 1 and female terminals (not shown) are accommodated therein. The female connector B includes a housing 6 accommodating male terminals corresponding to the female terminals. A hood 7 is provided for receiving the male connector A at the front portion of the housing 6. The hood 7 as well as the housing 1 has four outer side walls and includes pin guiding portions 8 corresponding to the cam pins 3 longitudinally on both side walls of the housing 6, and pins 9 for pivoting the lever member C. A notch 10 into which the releasing rib 4 enters and a positioning projection 11 are also arranged on one of the side walls of the housing 6. Further, a resilient locking piece 12 having a locking projection 12*a* is mounted on an outer front wall of the hood 7. Slits 13*a* are provided on an outer rear wall so as to form a flexible wall 13, and a preliminary locking notch 13*b* is arranged on the flexible wall 13.

Figure 8:
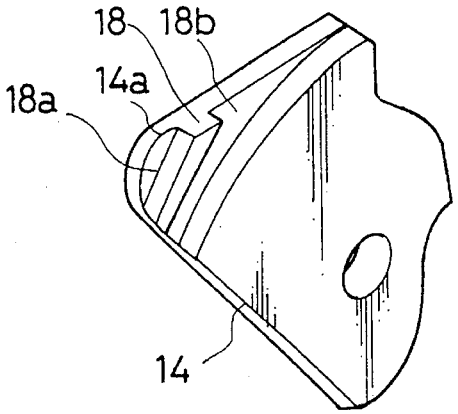
FIG. 8 is a perspective view showing a primary portion of the lever member.

The lever member C is formed in a U-shape in which shoulders of a pair of levers 14 are connected opposite to each other with a connecting portion 15. The levers 14 each has a shaft hole 16 and a cam groove 17 with an open end 17*a* on one side. A projection 18 is disposed within the inner surface of an end 14*a* of one of the levers 14, and large and small notched portions for relief 18*a* and 18*b* are formed within the inner and outer portions of the projection 18 (See FIG. 8). The cam grooves 17 have non-activating small projections 17*b* adjacent to the open ends 17*a* and on the edges of the grooves on the side of the pins 9, followed by first cam groove portions 17*c* for fitting the connectors and second cam groove portions 17*d* for relieving the locking operation so as not to activate the connectors (See FIG. 10).

The assembling work of the connector system with a lever will now be described. A pair of levers 14 of the lever member C are temporarily stretched outwardly by utilizing their flexibility, and the pin 9 of the female connector B is inserted into the shaft hole 16. At this time, the connecting portion 15 of the lever member C is engaged with a rear edge of the outer front wall of the female connector B and the end 14*a* of the lever 14 is engaged with the positioning projection 11, thereby securely maintaining the female connector B at a receiving position of the male connector A under the condition that the open end 17*a* of the lever member C is overlapped with the pin guiding portion 8 of the female connector B (See FIG. 2). A free end of the lever 14 of the lever member C is slidably engaged in a preventing portion 6' for preventing the disconnection which is disposed on one side of the housing 6.

Under the conditions described above, when the male connector A is inserted into the female connector B, a preliminary locking projection 5 is engaged with a preliminary notch 13*b*, and under this condition, the cam pin 3 enters into the pin guiding portion 8 so as to abut against the non-activating small projection 17*b*. At the same time, a tapered surface 4*a* of the releasing rib 4 abuts against the projection 18 of the lever 14 (See FIGS. 3 and 5). Then, on pressing the male connector A, the releasing rib 4 urges the end 14*a* of the lever 14 to open outwardly via the projection 18 so that the end 14*a* of the lever 14 is released from the positioning projection 11. At the same time, the cam pin 3 slightly pivots the lever member C in the direction indicated by arrow P via the non-activating small projection 17*b* so as to place the positioning projection 11 where the projection 11 is not in contact with the notched portion for relief 18*a* of the lever 14. As a result, an initial connecting state is obtained (See FIG. 4). In this state, the preventing portion 6' prevents the disconnection, which might be caused by excessive shifting.

Figure 6:
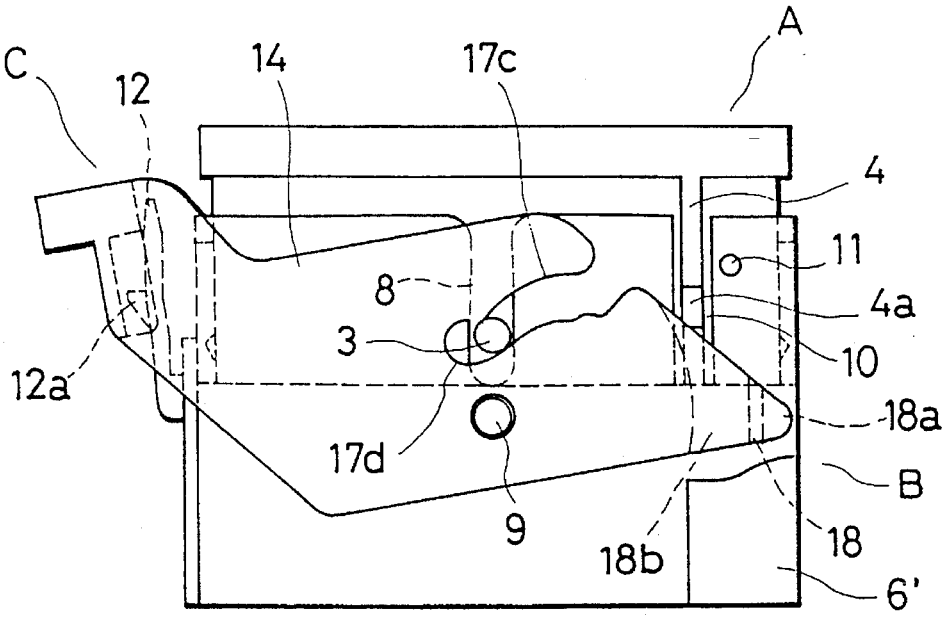
FIG. 6 is a side view of the male and female connectors upon complete connection when fully connected.
Figure 7:
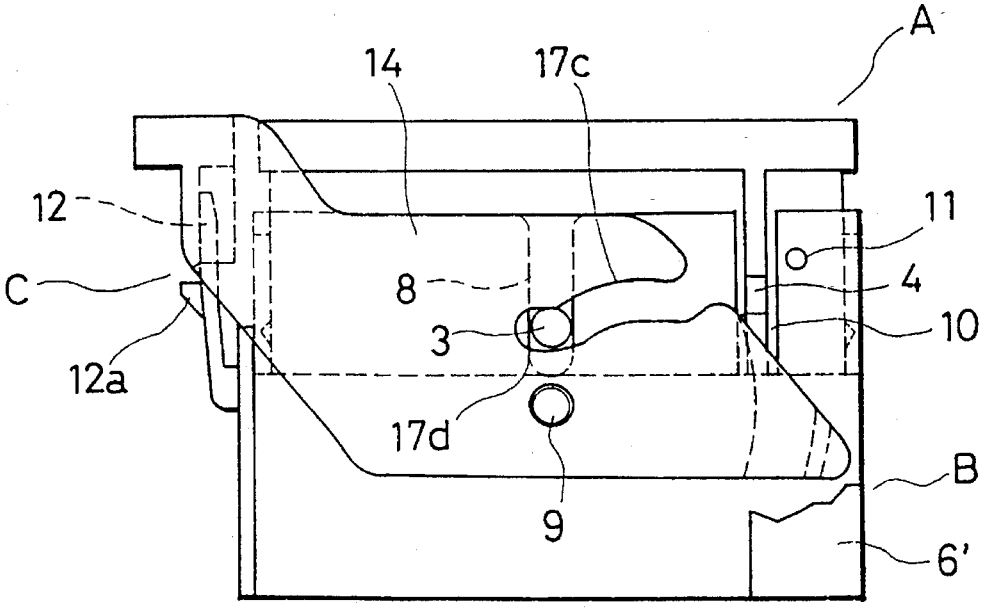
FIG. 7 is a side view of the locked male and female connectors.
Figure 9:
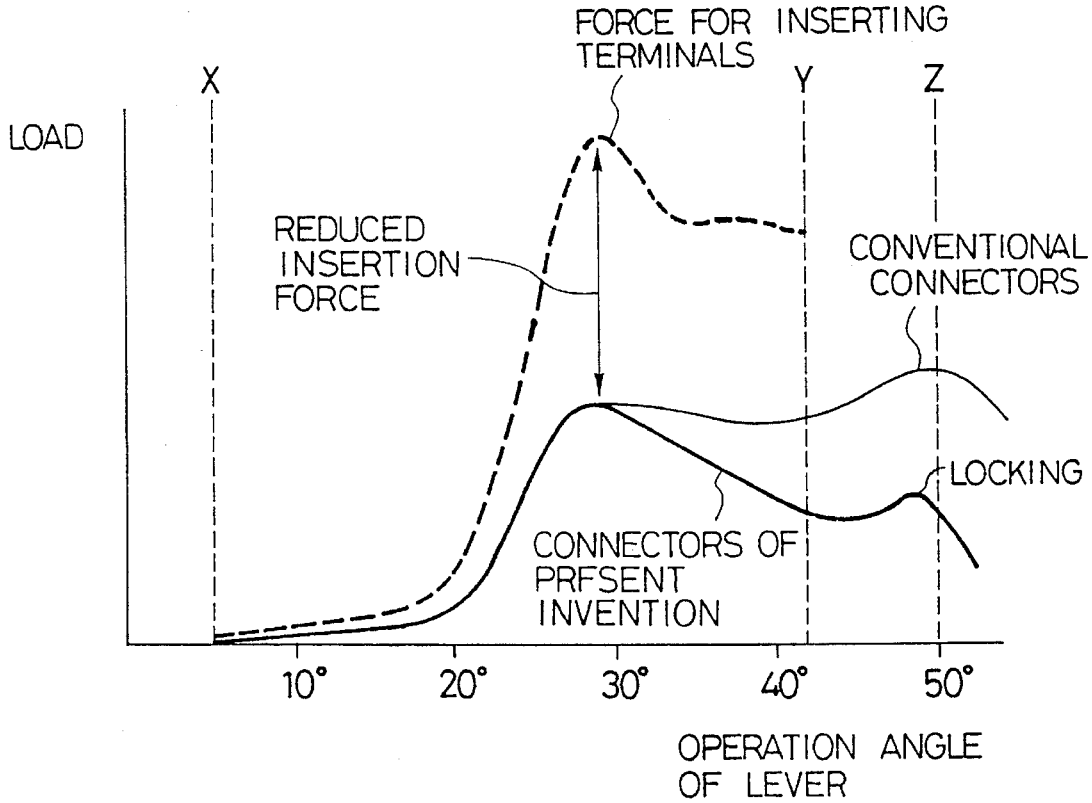
FIG. 9 is a graph showing the relationship between a lever operating angle and the engagement load of the connectors.
Figure 10:
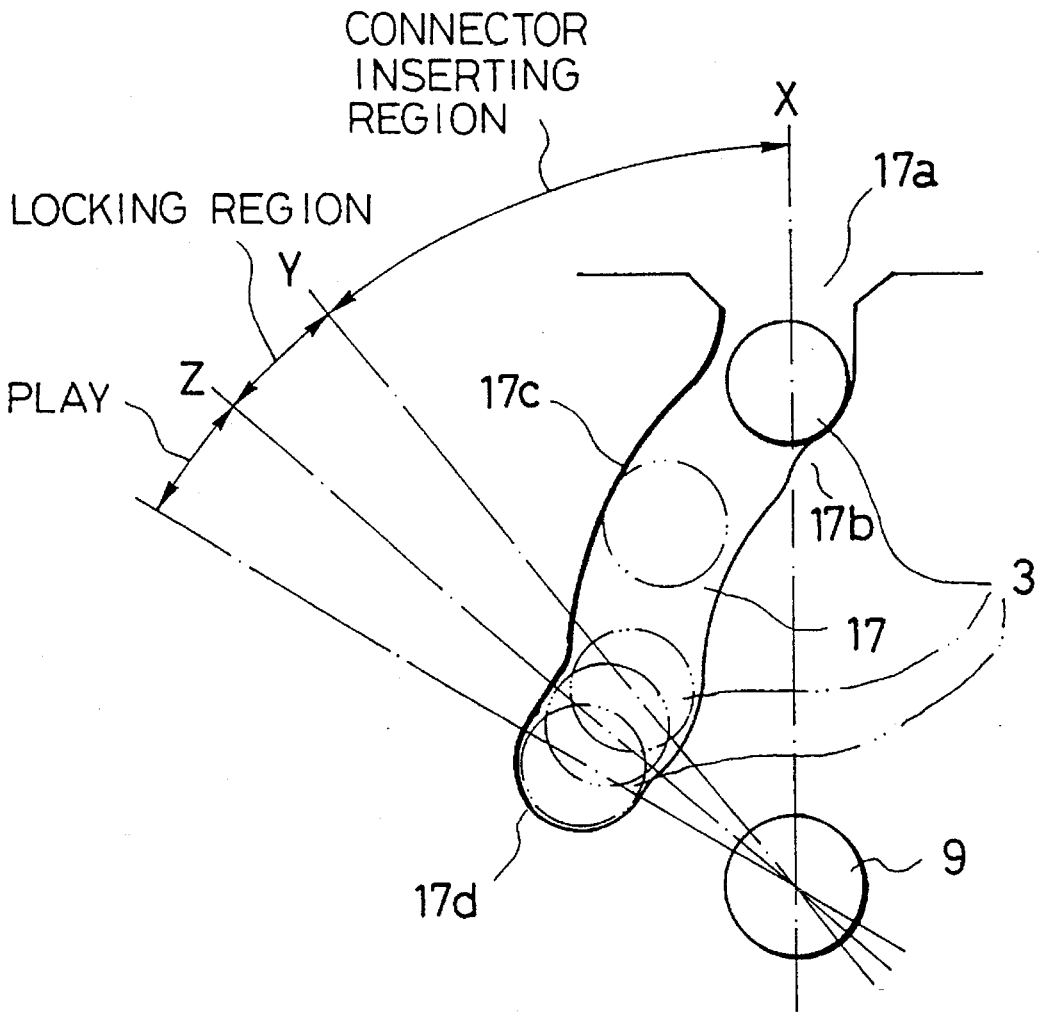
FIG. 10 is a view showing the process of connecting the male and female connectors relative to the operation angles of the lever.

Under the conditions described above, on pivoting the lever member C in the direction indicated by arrow P in the range from point X to point Y shown in FIGS. 9 and 10, the arch-like first cam groove 17*c* urges the male connector A to fit into the female connector B via the cam pin 3 so as to complete the connection of the connectors as shown in FIG. 6 (See point Y of FIG. 9). Subsequently, under the condition that the load for inserting the terminals is eliminated, the lever member C is pivoted by the second cam groove 17*d* so as to allow the rear end of the connecting portion 15 to be engaged with the locking projection 12*a* of the resilient locking piece 12 to obtain a locking state as shown in FIG. 7 (See point Z of FIG. 9). The graph of FIG. 9 shows that the load required for operating the lever is considerably decreased in the lever operation of the connector system according to the present invention, as indicated by the solid line, compared to that of the conventional connector indicated by the two-dot chain line.

Figure 11:
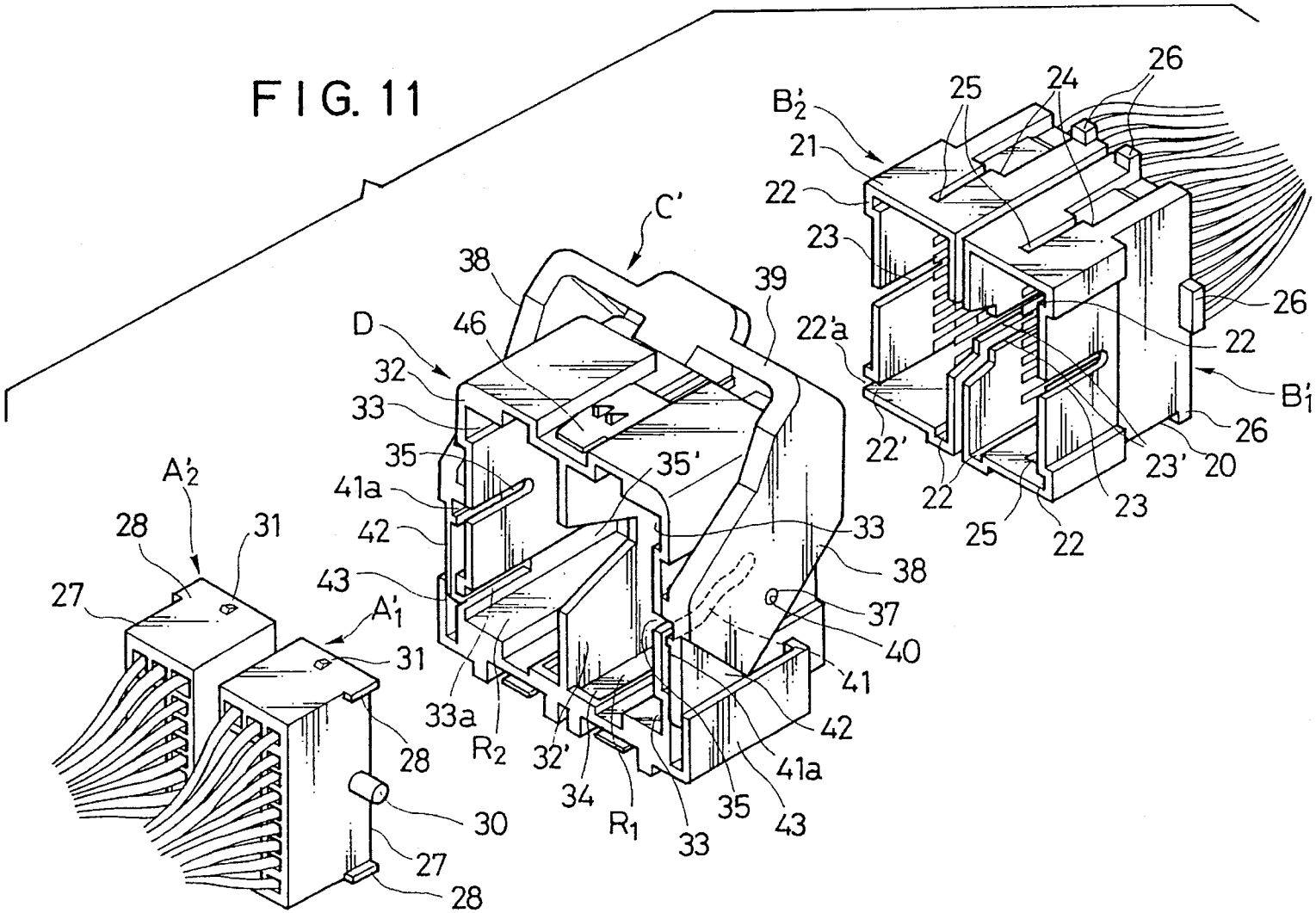
FIG. 11 is an exploded perspective view of a connector system showing another embodiment of the present invention.
Figure 12:
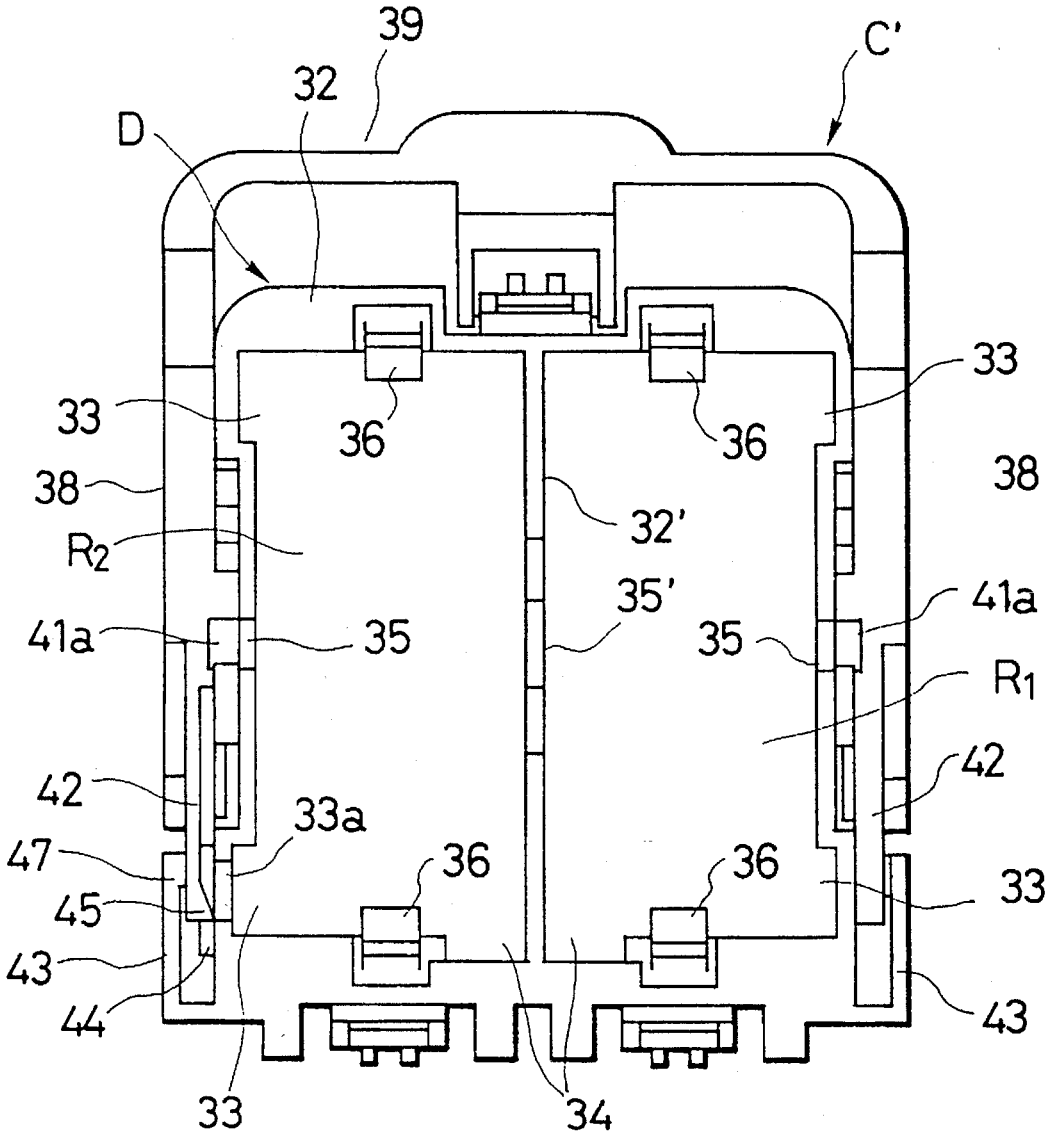
FIG. 12 is a front view of a frame with a lever.
Figure 13:
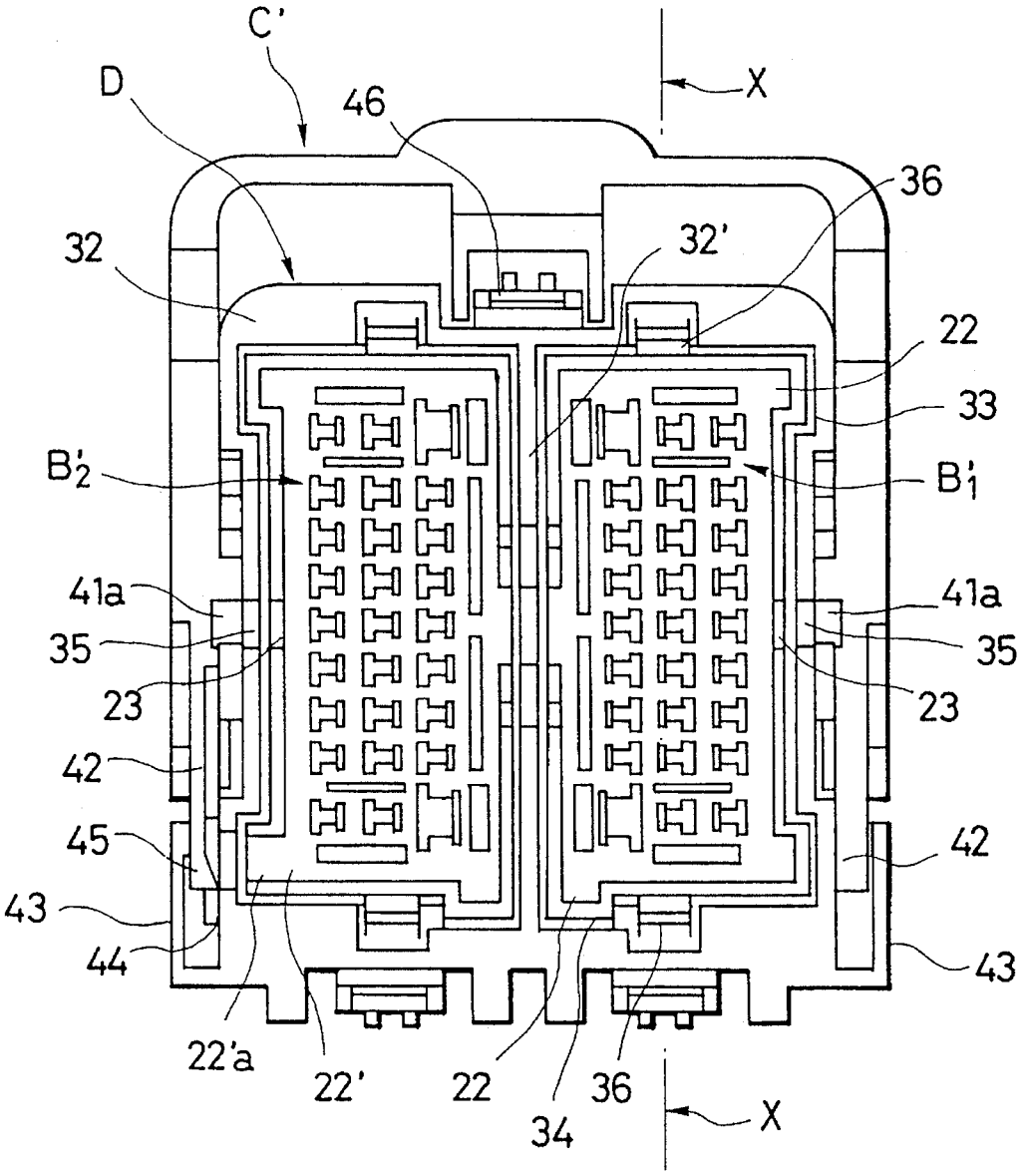
FIG. 13 is a front view of the frame with a lever to which the female connector is attached.

Another embodiment of a connector system requiring a small force by using an operation lever according to the present invention will now be described with reference to FIG. 11. The connector system includes a pair of male connectors $A_1'$ and $A_2'$, a pair of female connectors $B_1'$ and $B_2'$ and a frame D having a lever member C'. Each of the female connectors $B_1'$ and $B_2'$ has a housing 20 and a hood 21 on the front part of the housing 20. The hood 21 has front and rear side walls (in the direction of insertion) and top and bottom walls opposite to each other. Projecting accommodating portions 22 and 22' extending from a front end to a rear end of the hood 21 are formed on the top and bottom parts of one of the side walls and one end of the bottom walls of each connector. Pin guiding portions 23 and 23' extending from a front end to a rear end of the hood 21 are also formed in the middle part of one side of the side walls and in the middle part of the other side of the side walls opposite to each other of each connector. A guide notch 22a' is formed from a front end to a rear end of the hood 21 in the projecting accommodating portion 22' at the bottom of the female connector $B_2$'. On the top wall and the bottom wall of the housing 20, locking stepped portions 24 and locking notches 25 for the connection of the male connectors $A_1$' and $A_2$' Stoppers 26 are projected from the top and bottom walls and the side walls at the rear end of the hood 21.

Each of the male connectors $A_1$' and $A_2$' has a housing 27. In each housing 27, insertion adjusting projections 28 extending from a front end to a rear end of the housing 27 on the top and bottom parts of one of the side walls and on one end of the bottom walls of each connector and a releasing rib 29 are formed. A cam pin is projected from one of the side walls. On top and bottom walls of the housing 27, a preliminary locking projection 31 is disposed corresponding to the locking notch 25 of the housing 20 of the female connectors $B_1$' and $B_2$'.

The pair of male connectors $A_1$' and $A_2$' are connected to each other before they are inserted into the female connectors, and they have connecting parts $L_1$ and $L_2$, respectively, on each side wall opposite to each other for the purpose of inserting.

The frame D with a lever includes a surrounding frame 32 which is formed of a synthetic resin and which has side walls opposite to each other and top and bottom walls. The frame D also includes an intermediate wall 32' between the side walls opposite to each other so as to partition the frame D into two chambers $R_1$ and $R_2$ extending to pass from a front end to a rear end of the lever member C'. Enlarged accommodating portions 33 and 34 are formed on both side walls and bottom walls of the surrounding frame 32. Notched pin guiding portions 35 and 35' extending from a front end to a rear end of the lever member C' are also formed on both side walls of the frame 32 and on the intermediate wall 32'. The enlarged accommodating portion 33 on one side of the side walls includes a notched guiding portion 33a. In the chambers $R_1$ and $R_2$, cantilever resilient locking pieces 36 having locking portions 36a at their free ends are integrally mounted on the inner surfaces of the top and bottom walls. Supporting pins 37 are projected in the middle part of both side walls.

The lever member C' for operating an insertion is formed in a U-shape in which shoulders of a pair of levers 38 are connected opposite to each other with a connecting portion 39. Each of the levers 38 has a shaft hole 40 and a cam groove 41 with an open end 41a on one side. The shaft hole 40 of each lever 38 is engaged with the shaft 37 of the surrounding frame 32, thereby urging the lever member C' pivotably. A thin plate-like engaging portion 42 arranged at a free end of the non-connecting side of the lever 38 is engaged within preventing portions 43 for preventing the disconnection, which is disposed on the bottom of the side wall of the surrounding frame 32.

Figure 17:
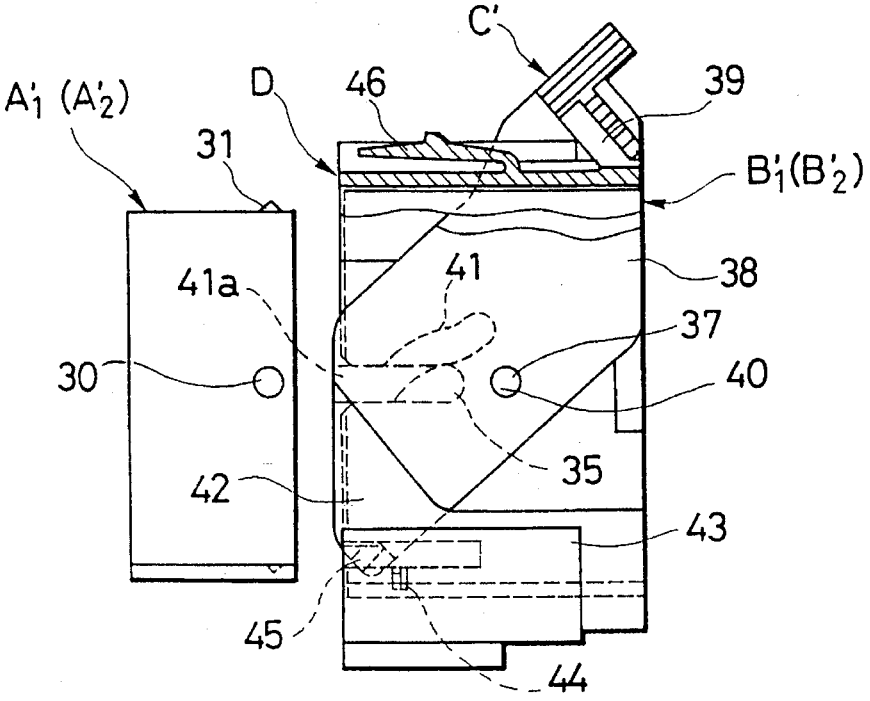
FIG. 17 is a side view of the connectors with a lever before insertion.

When the lever member C' is not operated as shown in FIG. 17, locking projections 45 at ends of the engaging portions 42 are engaged with the positioning projections 44 which are arranged on the side walls of the surrounding frame 32, and at the same time, the connecting portion 39 is engaged with the top wall of the surrounding frame 32, thereby stably securing the open ends 41a of the cam grooves 41 on the condition that the open ends 41a fit the pin guiding portions 35 correctly. A flexible locking piece 46 is arranged on the top wall of the surrounding frame 32 for securing the lever member C' at the operating position.

Figure 14:
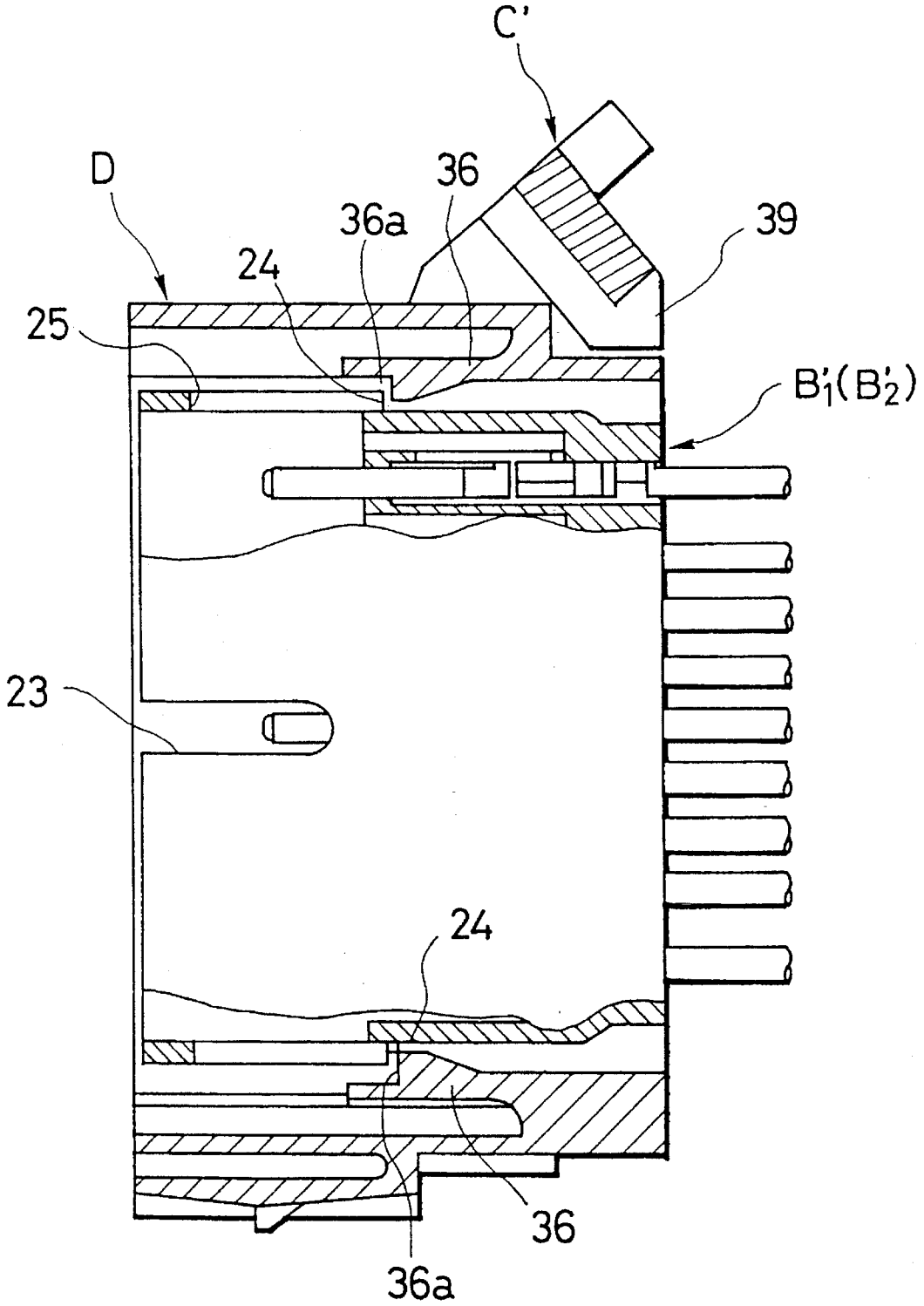
FIG. 14 is a sectional view taken on line XIV—XIV of FIG. 13.
Figure 15:
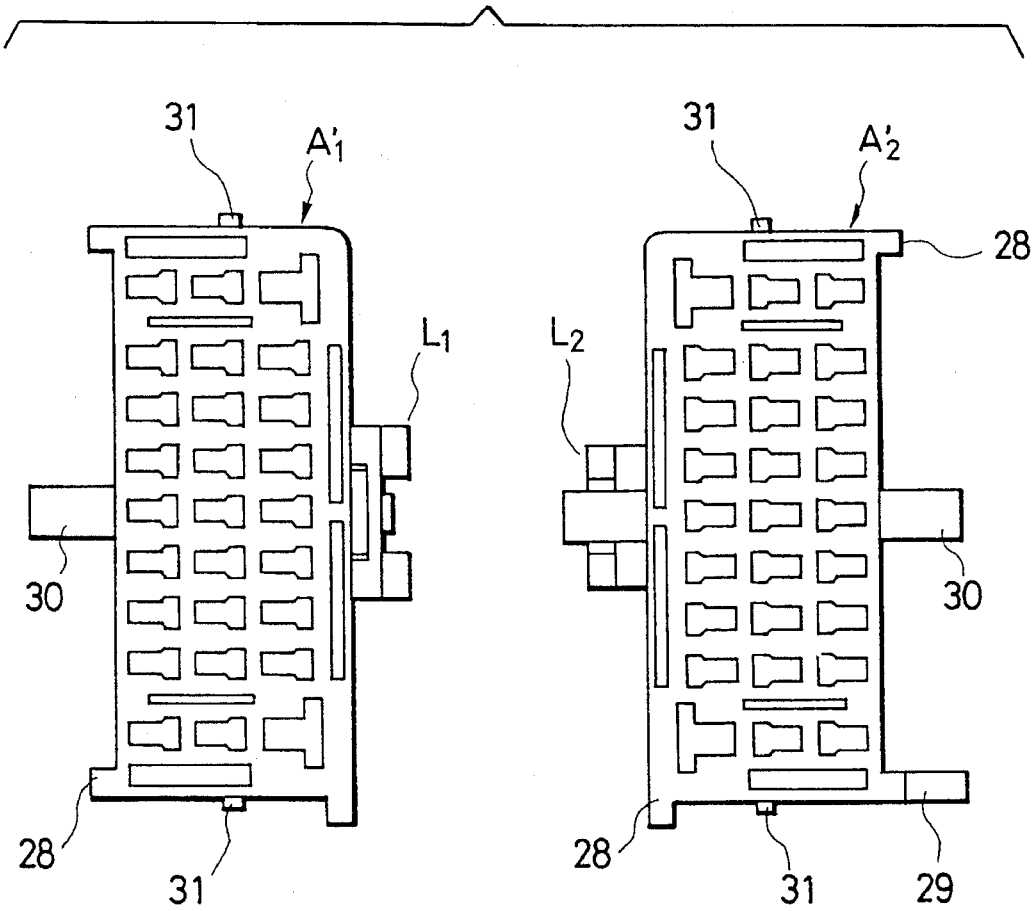
FIG. 15 is a front view of a pair of male connectors.
Figure 16:
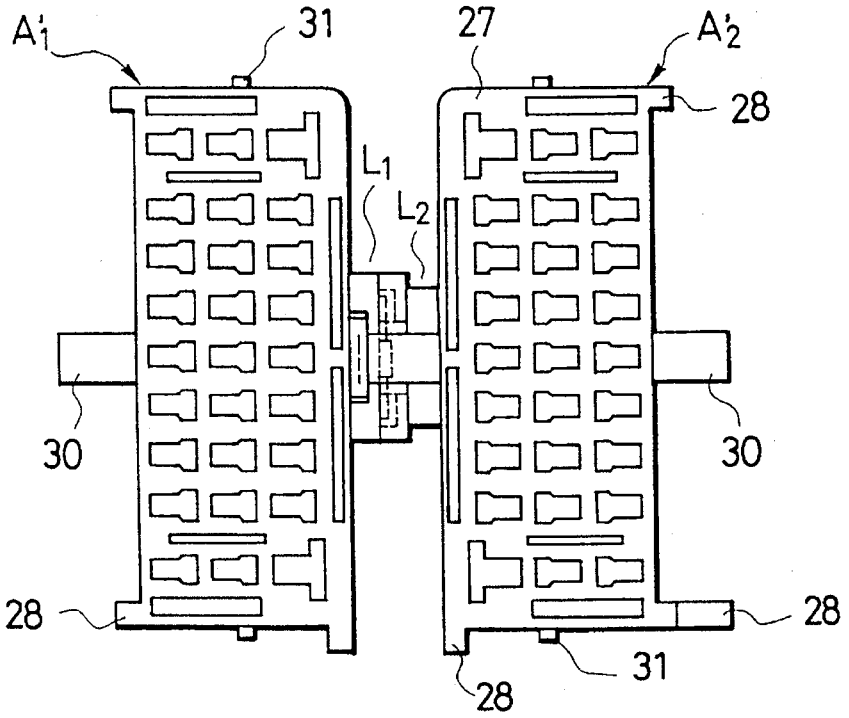
FIG. 16 is a front view showing the pair of male connectors being connected.

In the construction described above, the female connectors $B_1$' and $B_2$' are accommodated in the chambers $R_1$ and $R_2$ in the surrounding frame 32 of the frame D with a lever before they are connected to the male connectors $A_1$' and $A_2$'. The female connectors $B_1$' and $B_2$' are inserted into the lever member C' from the rear part of the surrounding frame 32 to such a degree that the stoppers 26 abut against the rear end of the surrounding frame 32. In this state, the flexible locking pieces 36 are engaged with the engaging stepped portions 24, thereby securing the female connectors $B_1$' and $B_2$' at a predetermined position (See FIG. 14). In this case, the pin guiding portions 23 and 23' of the female connectors $B_1$' and $B_2$' correspond parallel to the pin guiding portions 35 and 35' of the frame 32, and accordingly the open end 41a of the cam groove 41 in the lever member C' at the non-operating position also corresponds to the pin guiding portion 23.

Figure 18:
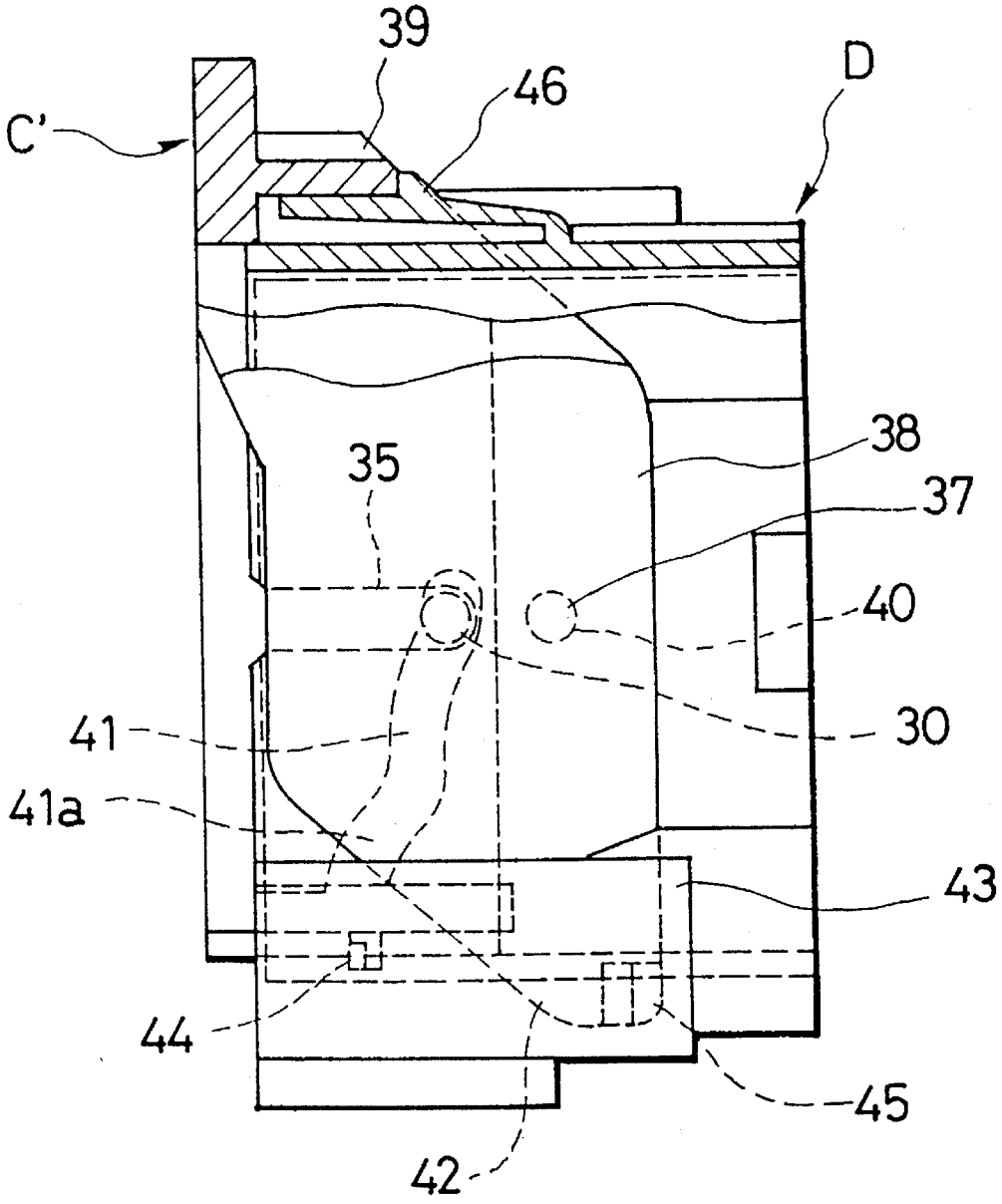
FIG. 18 is a side view of the connectors being connected to each other.
Figure 19:
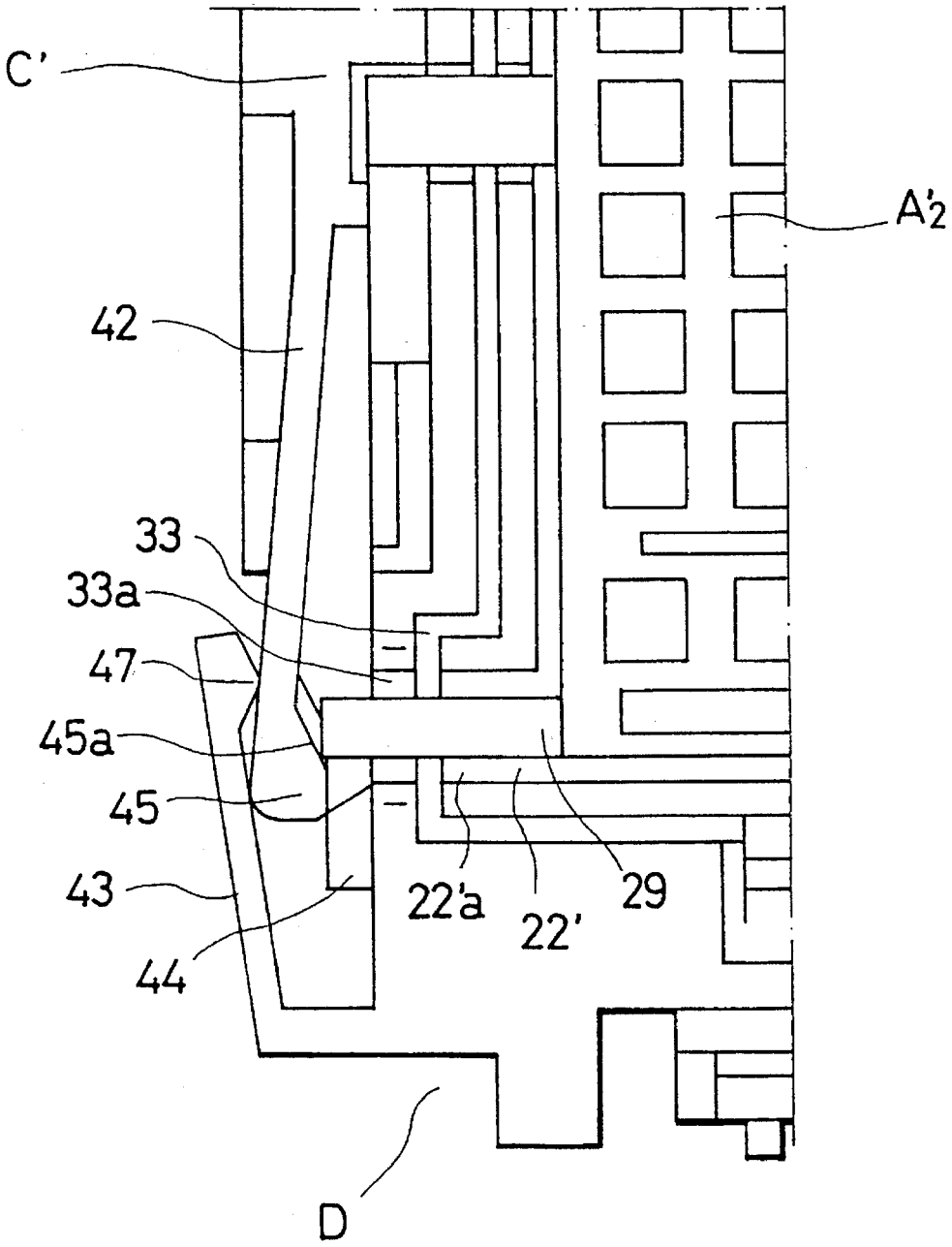
FIG. 19 is a front view of a primary portion of the connectors at the initial stage of the insertion.

Under the condition described above, a pair of male connectors $A_1$' and $A_2$' which are already connected to each other are inserted into the female connectors $B_1$' and $B_2$' positioned within the frame D with a lever. The preliminary locking projections 31 are engaged with the locking notches 25, and at the same time, the cam pins 30 are positioned at the pin guiding portions 23 and 25 and at the inlets of the cam grooves 41. Thus, the releasing rib 29 presses tapered surfaces 45a of locking projections 45, thereby shifting the free ends of the levers 38 outwardly and releasing the engagement with the positioning projections 44. Projections 47 of the preventing portions 43 prevent the disconnection, which may be caused by excessive shifting. Subsequently, the lever member C' is pivoted and the cam grooves 41 urge the male connectors $A_1$' and $A_2$' to be inserted into the female connectors $B_1$' and $B_2$' via the cam pins 30 so as to complete the connection. At the pivoting position, the connecting portion 39 of the lever member C' is engaged with the flexible locking piece 46 (See FIG. 18).

According to the foregoing description, the present invention offers the following advantages.

Since an inserting operation of a pair of connectors using a lever member and a locking operation of the lever member are carried out separately, the load for inserting the connectors can be decreased, and also locking can be completed speedily. Further, since the lever member is secured at a fixed position for the initial insertion without using a spring, the load for inserting the connectors can also be decreased.

What is claimed is:

1. A connector system requiring a small force by use of an operation lever, said system comprising:

a first connector having side walls opposite to each other and a cam pin arranged on each of said side walls;

a second connector having side walls opposite to each other and a pin guiding portion on each of said side walls, said pin guiding portion being capable of receiving said cam pin;

lever means having a cam groove with which said cam pin is engaged, and having a pair of levers pivoted to said second connector for operating the connection of said first connector and said second connector, said lever means having a connecting portion for connecting said pair of levers on the opposite side of an insertion direction, and wherein said second connector has a rearward side wall portion including a preventing portion for preventing the disconnection, said preventing portion being slidably engaged with the end of a non-connecting side of said lever means;

a positioning stopper arranged on said rearward side wall portion of said second connector and engaged with an end of one of said two levers; and a releasing member arranged on a rearward portion of one of the side walls of said first connector and engaged with a notch in said rearward side wall portion of the second connector;

said cam groove having an open end corresponding to said pin guiding portion of said second connector, when the end of said one of said two levers is engaged with said positioning stopper, and at an initial stage of insertion of said first connector into said second connector, said releasing member engages and urges said end of said one of said two levers to open outwardly and thereby release the engagement of said one of said two levers and said positioning stopper.

2. A connector system as defined in claim 1 wherein said releasing member is a rib projecting from the rearward side wall portion of said first connector, said rib including an inclined lower edge portion forming a camming surface to engage said end of said one of said two levers to move said end of said one of said two levers outwardly to release the engagement of said one of said two levers from said positioning stopper.

3. A connector system as defined in claim 1 wherein said preventing portion includes a partial side wall spaced from and generally parallel to said rearward side wall portion to slidably engage the end of a non-connecting side of said lever means.

4. A connector system as defined in claim 1 wherein each of said connectors includes a rear wall, said rear wall on the first connector having a preliminary locking projection adjacent a lower end thereof, the rear wall on the second connector including a slot adjacent an upper edge for receiving said projection to provide a preliminary locking connection between the first and second connectors.

5. A connector system requiring a small force by use of an operation lever, said connector system comprising:

a frame having side walls opposite to each other, an intermediate wall positioned between said side walls, and top and bottom walls;

first connector means and second connector means for connection to each other wherein one of said first connector means and said second connector means is a pair of female connectors having a housing which includes side walls opposite to each other and top and bottom walls, and wherein the other connector means is a pair of male connectors having a housing which includes side walls opposite to each other and top and bottom walls;

said frame surrounding and being slidably mountable on said second connector means before the connection of said first connector means and said second connector means;

pivotable lever means disposed on said frame for connecting said first connector means and said second connector means within said frame, said lever means having a pair of levers which are pivoted to each side wall of said frame, and a connecting portion for connecting said levers;

a positioning stopper disposed on said frame and engaged with said lever means in a non-operating position;

at least one pin arranged on said first connector means;

at least one cam groove arranged on said lever means and having an open end for advancing said pin in correspondence with a pivoting of said lever means in an inserting direction;

at least one pin guiding groove arranged on said frame and corresponding in location to said open end of said cam groove when said positioning stopper is engaged with said lever means;

a releasing member arranged on said first connector means for releasing the engagement of said lever means and said positioning stopper at an initial insertion stage of both said first connector means and said second connector means; and a preventing portion for preventing disconnection, said portion arranged on each side wall of said frame with which each end of a non-connecting side is slidably engaged.

* * * * *